US009750381B2

(12) United States Patent
Kim et al.

(10) Patent No.: US 9,750,381 B2
(45) Date of Patent: Sep. 5, 2017

(54) ROBOT CLEANER

(71) Applicant: LG Electronics Inc., Seoul (KR)

(72) Inventors: Jongsu Kim, Seoul (KR); Dongmyung Shin, Seoul (KR); Jaewon Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 908 days.

(21) Appl. No.: 13/900,194

(22) Filed: May 22, 2013

(65) Prior Publication Data

US 2013/0312215 A1 Nov. 28, 2013

(30) Foreign Application Priority Data

May 24, 2012 (KR) ..... 10-2012-0055400

(51) Int. Cl.
*A47L 9/22* (2006.01)
*A47L 11/18* (2006.01)
*A47L 11/20* (2006.01)

(52) U.S. Cl.
CPC ..... *A47L 9/22* (2013.01); *A47L 11/18* (2013.01); *A47L 11/20* (2013.01); *A47L 2201/00* (2013.01)

(58) Field of Classification Search
None
See application file for complete search history.

(56) References Cited

U.S. PATENT DOCUMENTS

| | | | | | |
|---|---|---|---|---|---|
| 2,524,117 | A * | 10/1950 | Storm, Jr. | A47L 5/14 | 15/331 |
| 5,134,752 | A * | 8/1992 | Shipman | A47L 5/30 | 15/351 |
| 2008/0023036 | A1* | 1/2008 | Ha | A47L 5/365 | 134/21 |
| 2008/0235897 | A1* | 10/2008 | Kim | A47L 7/02 | 15/319 |
| 2010/0313912 | A1 | 12/2010 | Han et al. | | |

FOREIGN PATENT DOCUMENTS

| | | | | |
|---|---|---|---|---|
| EP | 0803224 | | 10/1997 | |
| EP | 1842474 | A2 | 10/2007 | |
| EP | 1980188 | | 10/2008 | |
| IE | WO 2012077095 | A1 * | 6/2012 | A47L 5/22 |
| JP | 08-112224 | | 5/1996 | |
| KR | 10-2009-0067309 | A | 6/2009 | |
| KR | 10-2010-0123585 | A | 11/2010 | |
| KR | 10-1108049 | B1 | 1/2012 | |
| WO | 2010-143890 | A2 | 12/2010 | |
| WO | 2011-074716 | A1 | 6/2011 | |

* cited by examiner

*Primary Examiner* — Joseph J Hail
*Assistant Examiner* — Brian Keller
(74) *Attorney, Agent, or Firm* — Dentons US LLP

(57) ABSTRACT

Disclosed is a robot cleaner. The robot cleaner includes a case forming the external appearance of the robot cleaner, an agitator rotating and contacting a surface to be cleaned, a dust collector in which foreign substances are collected and a suction unit providing suction force to the dust collector, and the agitator is arranged between the dust collector and the suction unit. Therefore, the robot cleaner reduces loss of suction force generated from the suction unit.

18 Claims, 10 Drawing Sheets

ROBOT CLEANER

Pursuant to 35 U.S.C. §119(a), This application claims the benefit of Korean Patent Application No. 10-2012-0055400, filed on May 24, 2012, which is hereby incorporated by reference as if fully set forth herein.

BACKGROUND OF THE INVENTION

Field of the Invention

The present invention relates to a robot cleaner, and more particularly, to a robot cleaner which may reduce loss of suction force.

Discussion of the Related Art

In general, a robot has been developed for industrial use and took charge of factory automation. Recently, robot application fields are more increased, medical robots and aerospace robots are developed, and robots generally used in home are developed also.

As one representative example of robots used in home, there is a robot cleaner which sucks dust or foreign substances to clean a designated area while autonomously traveling about the designated area.

Such a robot cleaner is generally provided with a rechargeable battery and an obstacle sensor to avoid obstacles while traveling so as to perform cleaning while autonomously traveling.

As disclosed in Korean Patent Laid-open Publication No. 10-2010-0098997, a robot cleaner includes a casing forming the external appearance of the robot cleaner and provided with a suction hole through which dust or foreign substances are sucked into the casing, wheels provided on the casing, a drive motor to drive the wheels, a dust collector to collect the dust or foreign substances, and a suction motor connected to the dust collector.

SUMMARY OF THE INVENTION

Accordingly, the present invention is directed to a robot cleaner that substantially obviates one or more problems due to limitations and disadvantages of the related art.

An object of the present invention is to provide a robot cleaner which may reduce loss of suction force.

Another object of the present invention is to provide a robot cleaner which may improve suction force using a plurality of fans.

A further object of the present invention is to provide a robot cleaner which may reduce noise generated due to rotation of fans.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a robot cleaner includes a case forming the external appearance of the robot cleaner, an agitator rotating and contacting a surface to be cleaned, a dust collector in which foreign substances are collected, and a suction unit providing suction force to the dust collector, wherein the agitator is arranged between the dust collector and the suction unit.

An inlet through which foreign substances and air are sucked may be provided at the dust collector.

Particularly, the inlet may be formed at one side of the dust collector opposite the suction unit across the agitator, and air may be guided to the suction unit after passing through the dust collector.

The robot cleaner may further include a communication pipe communicating the dust collector and the suction unit with each other, and the communication pipe may be provided above the agitator.

A filter filtering out foreign substances may be provided in the communication pipe.

The dust collector may include a compression member compressing foreign substances, and the compression member may be reciprocally rotated about a vertical shaft to compress the foreign substances.

Further, the dust collector may include a guide provided above the compression member and guiding the air, sucked into the dust collector, to the suction unit.

The compression member may be reciprocally rotated about a horizontal shaft to compress the foreign substances.

The suction unit may include a guide duct unit guiding sucked air, a motor provided at one side of the guide duct unit, and air blower fans coaxially connected to a rotary shaft of the motor and rotated.

The rotary shaft of the motor may be arranged in parallel with an entrance of the guide duct.

The suction unit may further include a first bearing rotatably fixing one end of the rotary shaft of the motor to the guide duct unit.

The guide duct unit may include a first guide duct and a second guide duct arranged in parallel, and a first air blower fan and a second air blower fan may be provided in the first guide duct and the second guide duct.

Here, air may be divisionally sucked into the first guide duct and the second guide duct.

The suction unit may further include a second bearing rotatably fixing the rotary shaft at a portion of the rotary shaft which is coupled with the first air blower fan, and a third bearing rotatably fixing the rotary shaft at a portion of the rotary shaft which is coupled with the second air blower fan.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The sizes or shapes of elements illustrated in the accompanying drawings may be exaggerated, omitted, or schematically illustrated for clarity and convenience of description. Further, terms specially defined in consideration of the configuration and function of the present invention may be varied according to the intention of a user or an operator or the custom. Definition of these terms is given based on the description of the present invention.

Figure 1:
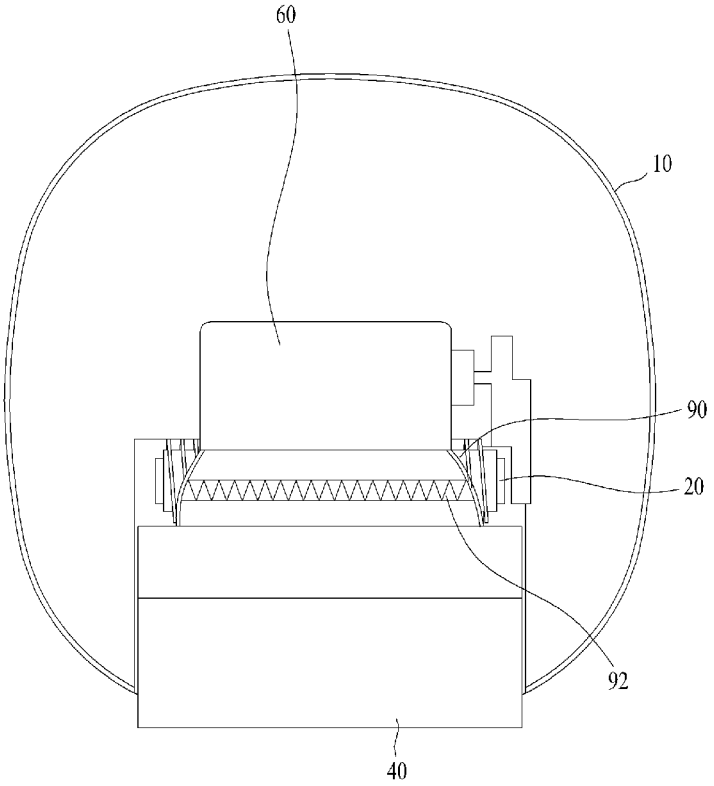
FIG. 1 is a plan view illustrating the inside of a robot cleaner in accordance with the present invention.

FIG. 1 is a plan view illustrating the inside of a robot cleaner in accordance with the present invention. Hereinafter, the robot cleaner will be described with reference to FIG. 1.

The robot cleaner in accordance with the present invention includes a case 10 forming the external appearance of the robot cleaner, a dust collector 40 collecting foreign substances, and a suction unit 60 providing suction force to the dust collector 40. The dust collector 40 and the suction unit 60 are accommodated in the case 10.

The robot cleaner in accordance with the present invention further includes an agitator 20 rotating and contacting a surface to be cleaned. Since the agitator 20 is located in the lower portion of the case 10, FIG. 1 illustrates the agitator 20, a part of the shape of which is hidden. Such an agitator 20 is fixed to the case 10 so as to be rotatable, and when agitator 20 contacts the surface to be cleaned, foreign substances may be removed from the surface to be cleaned and then sucked into the robot cleaner.

Further, the robot cleaner in accordance with the present invention includes a communication pipe 90 interconnecting the dust collector 40 and the suction unit 60. A filter 92 may be provided in the communication pipe 90. The filter 92 may prevent foreign substances collected in the dust collector 40 from moving to the suction unit 60.

Particularly, the agitator 20 may be arranged between the dust collector 40 and the suction unit 60. That is, the dust collector 40 and the suction unit 60 may be arranged at both sides of the agitator 20.

In the present invention, since the agitator 20 and the communication pipe 90 are stacked as seen from the top, as shown in FIG. 1, spaces occupied by the agitator 20 and the communication pipe 90 are overlapped and thus a space occupied by the robot cleaner may be reduced. The agitator 20 is arranged in the lower portion of the case 10 so as to be exposed to the outside, and thus does not require the entirety of the vertical space within the case 10. Therefore, the agitator 20 and the communication pipe 90 may be arranged so as to be overlapped as seen from the top. The reason for this is that the communication pipe 90 does not use a lower space occupied by the agitator 20 from among the inner space within the case 10 but may use only an upper space provided above the agitator 20.

If the communication pipe 90 is not installed, a space corresponding to the upper space provided above the agitator 20 from among the inner space within the case 10 becomes a dead space. Therefore, the communication pipe 90 may be arranged in such a dead space, thus more effectively using the inner space of the robot cleaner. Thereby, essential components, such as a sensor and a battery, may be more freely arranged within the case 10.

In the robot cleaner in accordance with the present invention, air sucked from the surface to be cleaned is not guided to the suction unit 60 by traversing the inside of the dust collector 40, and thus, a movement path of air within the case 10 may be shortened. Because the dust collector 40 and the suction unit 60 are arranged at sides of the agitator 20, and flow of air sucked into the dust collector 40 is changed before air reaching one end of the dust collector 40 reaches the other end of the dust collector 40 so as to move to the suction unit 60. Such air flow will be described in more detail later.

The dust collector 40 may be provided at one edge of the case 10 so as to allow a user to easily attach/detach the dust collector 40 to/from the case 10. In order to discharge foreign substances collected in the dust collector 40 from the dust collector 40, the user may attach/detach the dust collector 40 to/from the case 10.

Although not shown in FIG. 1, the robot cleaner is provided with wheels, a drive motor driving the wheels, and a battery-type power supply providing electricity.

In order to move the robot cleaner to a desired position, the wheels may include a left wheel and a right wheel. Here, the left wheel and the right wheel may be rotated at different rotating speeds so that the robot cleaner may be rotated in the leftward or rightward direction. Of course, the left wheel and the right wheel may be rotated at the same rotating speed so that the robot cleaner may move forward or backward.

Figure 2:
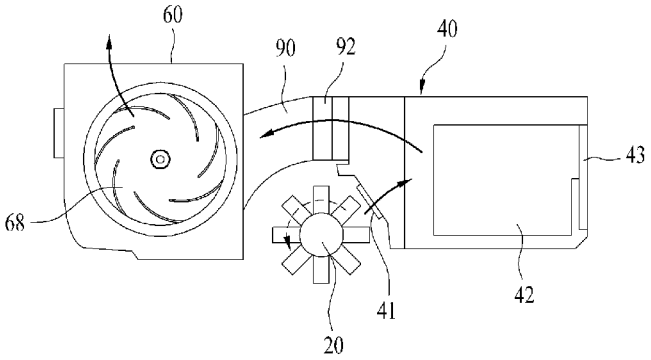
FIG. 2 is a schematic longitudinal-sectional view of a dust collector in accordance with one embodiment of the present invention.
Figure 3:
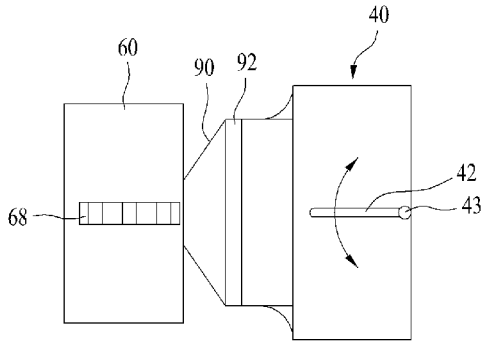
FIG. 3 is a plan view of FIG. 2.

FIG. 2 is a schematic longitudinal-sectional view of a dust collector in accordance with one embodiment of the present invention, and FIG. 3 is a plan view of FIG. 2. Hereinafter, the dust collector in accordance with this embodiment will be described with reference to FIGS. 2 and 3.

As shown in FIG. 2, the suction unit 60, the communication pipe 90 and the dust collector 40 are arranged from the left, and the agitator 20 is provided below the communication pipe 90.

The agitator 20 is arranged between the dust collector 40 and the suction unit 60. That is, the dust collector 40 is arranged at one side of the agitator 20, and the suction unit 60 is arranged at the other side of the agitator 20.

An inlet 41 through which foreign substances and air are sucked into the dust collector 40 is provided at the dust collector 40. Here, the inlet 40 is formed at the side of the dust collector 40 opposite the suction unit 60 across the agitator 20.

The inlet 41 may be inclined at a designated angle while facing the agitator 20. For example, if the inlet 41 is formed in parallel with the surface to be cleaned, i.e., the horizontal surface, when suction force to foreign substances sucked through the inlet 41 is weakened, the foreign substances may be fallen back to the surface to be cleaned through the inlet 41 by gravity.

In the other hand, if the inlet 41 is formed perpendicularly to the surface to be cleaned, i.e., the horizontal surface, in order to cause air sucked into the dust collector 40 through the inlet 41 to move to the suction unit 60, an angle of 180 degrees needs to be changed without a portion, the angle of which is easily changed. Since the movement path of sucked air is suddenly changed in the opposite direction, loss of suction force may occur. Air sucked through the inlet 41 needs to flow toward the communication pipe 90, and the inlet 41 and the communication pipe 90 are arranged in opposite directions. Therefore, in consideration of flow of air and foreign substances sucked through the inlet 41, the inlet 41 may be arranged so as to be inclined at a designated angle from the surface to be cleaned.

If the agitator 20 is rotated in the counterclockwise direction in FIG. 2, air and foreign substances may be more easily sucked through the inlet 41. That is, the reason for this is that the direction of flow of air generated by rotation of the agitator 20 or the direction of foreign substance, moving by rotation of the agitator 20 coincides with the suction direction at the inlet 41.

The dust collector 40 is provided with a designated space formed therein, and may thus maintain a state in which foreign substances sucked through the inlet 41 is collected in the dust collector 40. Further, the dust collector 40 may include a compression member 42 compressing foreign substances so that the sucked foreign substances may move to the rear portion of the dust collector 40, i.e., the other side of the dust collector 40 opposite to the inlet 41. Less influence of air sucked through the inlet 41 may be applied to the other side of the dust collector 40 opposite to the inlet 41.

The compression member 42 may be formed in the shape of a plate having a designated area. Here, a separate drive motor to rotate the compression member 42 may be provided.

The compression member 42 is reciprocally rotated about a vertical shaft 43 provided at one end of the compression member 42, and may thus compress foreign substances. If foreign substances are located adjacent to the inlet 41 and stayed on the inner surface of the dust collector 40, the foreign substances may move to the inside of the dust collector 40 by movement of the compression member 42. That is, the compression member 42 applies force to move foreign substances in the dust collector 40 regardless of suction force of the suction unit 60.

The communication pipe 90 is arranged between the dust collector 40 and the suction unit 60. Here, the filter 92 is provided within the communication pipe 90, and may thus prevent foreign substances sucked into the dust collector 40 from moving to the suction unit 60 and damaging the suction unit 60. Further, the filter 92 may prevent the foreign substances from being discharged back to the outside of the case 10 through the suction unit 60. Air may move from the dust collector 40 to the suction unit 60 through the filter 92, but foreign substances does not move from the dust collector 40 to the suction unit 60 through the filter 92.

The suction unit 60 includes air blower fans 68 generating suction force in the dust collector 40. When the air blower fans 68 are rotated, foreign substances and air flow into the dust collector 40 through the inlet 41, and then air alone moves to the suction unit 60 through the filter 92 and is then discharged to the outside.

The communication pipe 90 is provided above the agitator 20. Since the dust collector 40, the suction unit 60, the agitator 20 and the communication pipe 90 may be arranged closely, a space occupied by components may be reduced through such an arrangement.

Hereinafter, operation of the dust collector in accordance with this embodiment will be described.

First, when the air blower fans 68 of the suction unit 60 are driven, the suction unit 60 generates suction force. Since the suction unit 60 is connected to the dust collector 40 through the communication pipe 90, suction is carried out also in the dust collector 40. If the agitator 20 is rotated in the counterclockwise direction, the agitator 20 may assist suction of foreign substances and air.

Air and foreign substances sucked through the inlet 41 flow into the dust collector 40. Since the compression member 42 is reciprocally rotated in the leftward and rightward directions about the vertical shaft 43, the foreign substances having a volume are guided to the inside of the dust collector 40 so as to become distant from the inlet 41. Therefore, the foreign substances are entangled within the dust collector 40 and are thus compressed, and the space within the dust collector 40 may be increased.

On the other hand, air guided to the dust collector 40 moves to the communication pipe 90, passes through the filter 92, and is then guided to the suction unit 60. Particularly, since air is sucked into the inlet 41 provided at the lower portion of the dust collector 40 and is then guided to the communication pipe 90 connected to the upper portion of the dust collector 40, the direction of the air is changed. Since the foreign substances collected in the dust collector 40 are compressed so as to become distant from the inlet 41, air sucked into the inlet 41 may easily move to the communication pipe 90.

Particularly, air guided to the communication pipe 90 after passing through the dust collector 40 does not traverse the inside of the dust collector 40. Here, 'traverse' means that an entrance is formed at a left end of the dust collector, an exit is formed at a right end of the dust collector and thus, air moves while passing through the entirety of the inside of the dust collector. That is, since air passes through the dust collector 40 using the inlet 41 and the communication pipe 90 provided on the same side surface of the dust collector 40 as an entrance and an exit, the movement distance of the air within the dust collector 40 may be shortened. Consequently, a length of air finally guided to the suction unit 60 after sucked into the inlet 41, i.e., the path of such air, is shortened, and thus, loss of suction force generated from the suction unit 60 may be reduced. For example, if the length from the inlet 41 to the suction unit 60 is increased, suction force at the inlet 41 may be decreased due to loss generated by friction even if the suction unit generating the same suction force is used.

Figure 4:
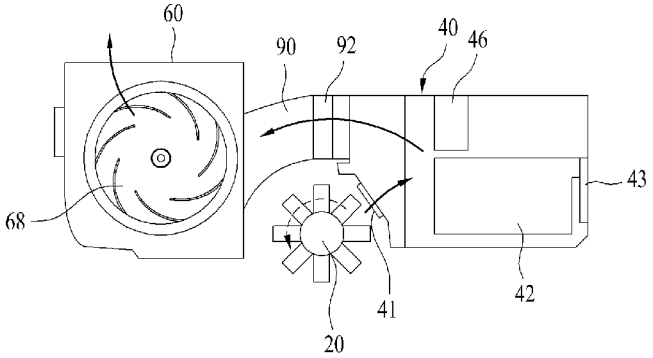
FIG. 4 is a schematic longitudinal-sectional view of a dust collector in accordance with another embodiment of the present invention.
Figure 5:
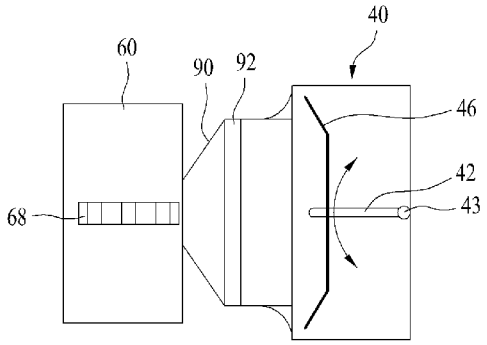
FIG. 5 is a plan view of FIG. 4.

FIG. 4 is a schematic longitudinal-sectional view of a dust collector in accordance with another embodiment of the present invention, and FIG. 5 is a plan view of FIG. 4. Hereinafter, the dust collector in accordance with this embodiment will be described with reference to FIGS. 4 and 5.

The dust collector 40 in accordance with this embodiment shown in FIGS. 4 and 5 is the same as the dust collector 40 in accordance with the former embodiment shown in FIGS. 2 and 3 except that the dust collector 40 in accordance with this embodiment includes a guide 46 guiding air sucked into the dust collector 40 to the suction unit 60. A description of some parts in this embodiment which are substantially the same as those in the former embodiment will be omitted because it is considered to be unnecessary, and only parts in this embodiment which are different from the former embodiment will be described.

The guide 46 is arranged adjacent to the upper portion of the dust collector 40, i.e., a portion of the dust collector 40 to which the communication pipe 90 is connected. As shown in FIG. 5, both surfaces of the guide 46 installed at both sides of a central surface of the guide 46 may be spread toward the communication pipe 90 at a designated inclination angle. The guide 46 may more easily guide air sucked through the inlet 41 to the communication pipe 90. The guide 46 functions as a reflection plate to air sucked through the inlet 41, and may cause the air to move to the communication pipe 90 after collision with the guide 46.

The guide 46 may be modified to other shapes as long as the guide 46 easily guides air sucked through the inlet 41 to the communication pipe 90.

If the volume of the dust collector in accordance with this embodiment shown in FIGS. 4 and 5 is the same as the volume of the dust collector in accordance with the above-described former embodiment shown in FIGS. 2 and 3, the size of the compression member 42 may be reduced. The reason for this is that, in this embodiment, differing from the former embodiment, the guide 46 is provided above the compression member 42 and a space for installation of the guide 46 is required.

Figure 6:
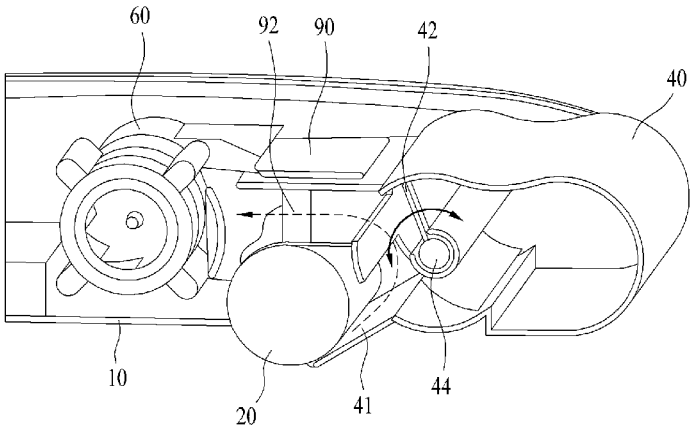
FIG. 6 is a schematic perspective view of a dust collector in accordance with a further embodiment of the present invention.

FIG. 6 is a schematic perspective view of a dust collector in accordance with a further embodiment of the present invention. Hereinafter, the dust collector in accordance with this embodiment will be described with reference to FIG. 6.

The dust collector 40 in accordance with this embodiment shown in FIG. 6 is the same as the dust collector 40 in accordance with the former embodiment shown in FIGS. 2 and 3 except that the dust collector 40 in accordance with this embodiment is reciprocally rotated about a horizontal axis other than a vertical axis. A description of some parts in this embodiment shown in FIG. 6 which are substantially the same as those in the former embodiment shown in FIGS. 2 and 3 will be omitted because it is considered to be unnecessary, but relating contents are applied to this embodiment.

The compression member 42 is reciprocally rotated in the upward and downward directions about a horizontal shaft 44, and thus may compresses foreign substances. That is, foreign substances sucked through the inlet 41 and accumulated adjacent to the inlet 41 may move to the inside of the dust collector 40 by movement of the compression member 42.

Here, reciprocal rotation of the compression member 42 in the upward and downward directions may be generated only for a specific time.

For example, if the suction unit 60 generates suction force, the compression member 42 moves to the highest position and may thus perform a similar function to the guide 46 in accordance with the embodiment shown in FIGS. 4 and 5. Since the compression member 42 is provided at the upper portion of the dust collector 40 so as to be inclined at a designated angle toward the communication pipe 90, air sucked through the inlet 41 collides with the compression member 42, and the movement direction of the air may be changed toward the communication pipe 90.

On the other hand, if the suction unit 60 does not generate suction force, the compression member 42 is reciprocally rotated in the upward and downward directions for a designated time, and may thus guide foreign substances to the inside of the dust collector 40. The foreign substances guided to the inside of the dust collector 40 may be compressed by rotation of the compression member 42.

Figure 7:
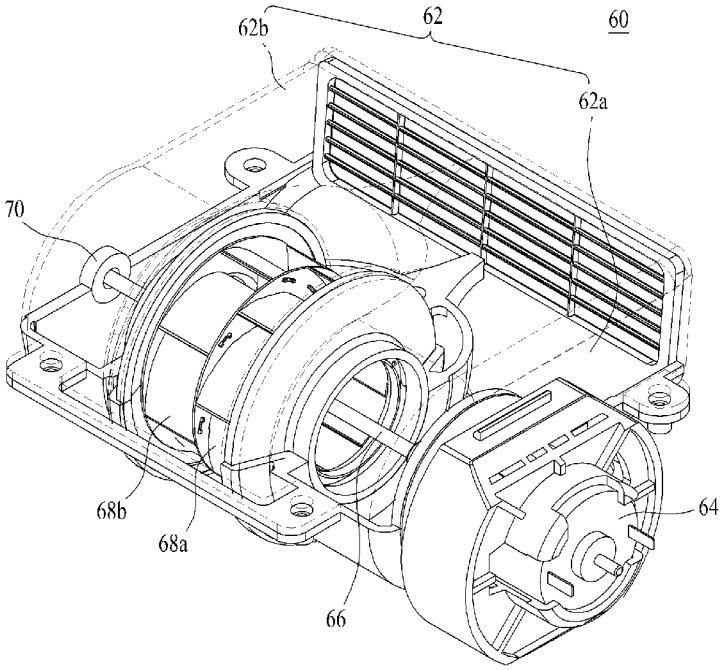
FIG. 7 is a perspective view of a suction unit in accordance with the present invention.

FIG. 7 is a perspective view of the suction unit in accordance with the present invention. Hereinafter, the suction unit will be described with reference to FIG. 7.

The suction unit 60 includes a guide duct unit 62 guiding sucked air, a motor 64 provided at one side of the guide duct unit 62, and air blower fans 68 coaxially connected to a rotary shaft 66 of the motor 64 and rotated.

The rotary shaft 66 of the motor 64 may be arranged in parallel with the entrance of the guide duct unit 62. That is, since the rotary shaft of the air blower fans 68 is the same as the rotary shaft 66 of the motor 64, the rotary shaft of the air blower fans 68 may be arranged in parallel with the entrance of the guide duct unit 62. Therefore, the center of the rotary shaft of the air blower fans 68 and the direction of air flowing from the entrance of the guide duct unit 62 may be perpendicular to each other.

The guide duct unit 62 may include a first guide duct 62*a* and a second guide duct 62*b* arranged in parallel. The first guide duct 62*a* and the second guide duct 62*b* are arranged in parallel with each other, and a first air blower fan 68*a* and a second air blower fan 68*b* may be provided in the first guide duct 62*a* and the second guide duct 62*b*.

Since the first air blower fan 68*a* and the second air blower fan 68*b* have blades independently generating air flows, the blades may generate flows of air respectively sucked into the first guide duct 62*a* and the second guide duct 62*b* by rotation of the air blower fans 68*a* and 68*b*.

The first guide duct 62*a* and the second guide duct 62*b* have similar shapes, and are provided with independent flow paths along which air may flow. Therefore, air may be divisionally sucked into the first guide duct 62*a* and the second guide duct 62*b*. In the same manner, air flowing into the first guide duct 62*a* and air flowing into the second guide duct 62*b* may be independently discharged to the outside through the first air blower fan 68*a* and the second air blower fan 68*b*.

In the present invention, two air blower fans are used, and thus, suction force may be doubled. Further, in the present invention, if the cross-sectional area of the entrances of the first guide duct 62*a* and the second guide duct 62*b* is equal to the cross-sectional area of the entrance of a conventional guide duct, suction force of the respective air blower fans is uniformly dispersed at the entrances of the first guide duct 62*a* and the second guide duct 62*b*, and thus loss of suction force may be reduced.

The motor 64 may be installed at one side of the first guide duct 62*a*, and a first bearing 70 rotatably supporting the rotary shaft 66 of the motor 64 may be installed at one side of the second guide duct 62*b* opposite to the motor 64.

The first bearing 70 is formed in a cylindrical shape, the outer surface of the first bearing 70 is supported by the second guide duct 62*b*, and the rotary shaft 66 of the motor 64 is rotatably inserted into the first bearing 70.

That is, one end of the rotary shaft 66 of the motor 64 is supported by the motor 64, and the other end of the rotary shaft 66 is supported by the first bearing 70. Therefore, since both ends of the rotary shaft 66 of the motor 64 are supported, noise and vibration generated when the rotary shaft 66 is rotated may be reduced.

Figure 8:
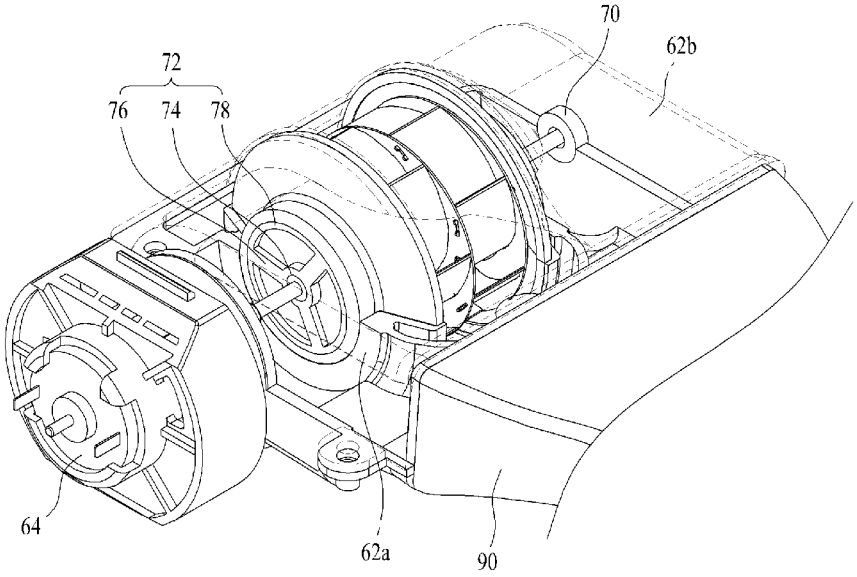
FIG. 8 is a view illustrating a modification of the suction unit of FIG. 7.

FIG. 8 is a view illustrating a modification of the suction unit of FIG. 7. Hereinafter, such a modification will be described with reference to FIG. 8.

The suction unit in accordance with the modification shown in FIG. 8 is the same as the suction unit shown in FIG. 7 except that the suction unit in accordance with the modification shown in FIG. 8 further includes a second bearing 72 provided at a portion of the rotary shaft 66 which is coupled with the first air blower fan 68*a* so as to rotatably fix the rotary shaft 66.

That is, in the modification of FIG. 8, since the number of support points of the rotary shaft 66 of the motor 64 is increased as compared with the suction unit shown in FIG.

7, the rotary shaft 66 may be more stably supported and noise and vibration caused by the rotary shaft 66 may be reduced.

The second bearing 72 may include a first mount surface 74 rotatably supporting the rotary shaft 66, ribs 76 extending from the first mount surface 74 in the radial direction, and a second mount surface 78 provided at the outer ends of the ribs 76.

The second mount surface 78 may be supported by the first guide duct 62*a* or the first air blower fan 68*a*. If the second mount surface 78 contacts the first guide duct 62*a*, the second mount surface 78 is supported by the first guide duct 62*a*. On the other hand, if the second mount surface 78 contacts the first air blower fan 68*a*, the second mount surface 78 is supported by the first air blower fan 68*a*.

Since the plural ribs 76 are arranged in the radial direction between the first mount surface 74 and the second mount surface 78, the first mount surface 74 may stably support the rotary shaft 66.

Figure 9:
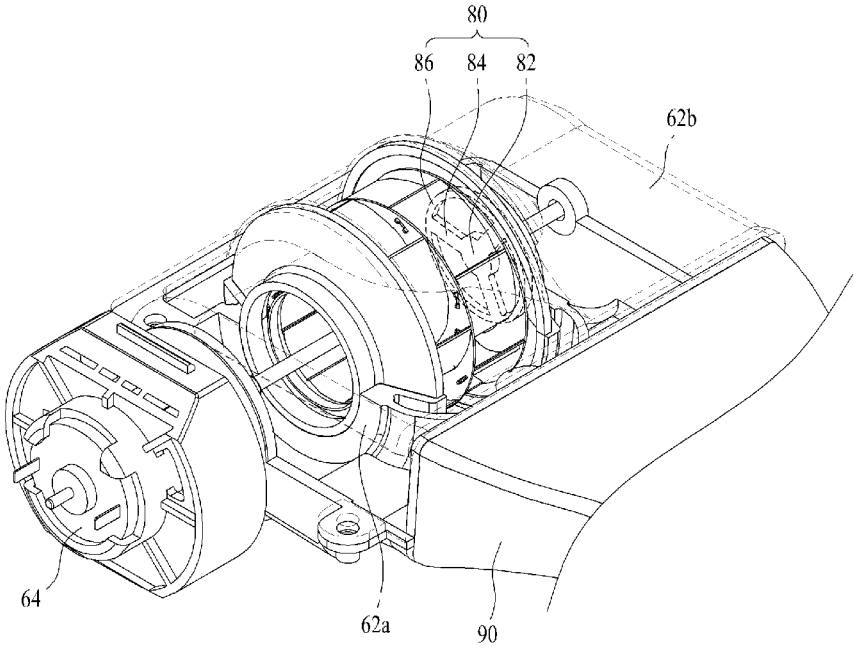
FIG. 9 is a view illustrating another modification of the suction unit of FIG. 7.

FIG. 9 is a view illustrating another modification the suction unit of FIG. 7.

The suction unit in accordance with the modification shown in FIG. 9 may further include a third bearing 80 provided at a portion of the rotary shaft 66 which is coupled with the second air blower fan 68*b* so as to fix the rotary shaft 66, differently from the suction unit shown in FIG. 7.

In the same manner as the second bearing 72, the third bearing 80 may include a first mount surface 82 located at the center of the third bearing 80, plural ribs 84 extending from the first mount surface 82 in the radial direction, and a second mount surface 86 provided at the outer ends of the ribs 84.

However, the third bearing 80 differs from the second bearing 72 in that the third bearing 80 causes the rotary shaft 66 to be rotatably supported by the second guide duct 62*b* or the second air blower fan 68*b*.

As shown in FIG. 9, if the third bearing 80 is added, the rotary shaft 66 is supported by the motor 64, the first bearing 80 and the third bearing 80, and thus noise and vibration generated from the rotary shaft 66 may be reduced.

Figure 10:
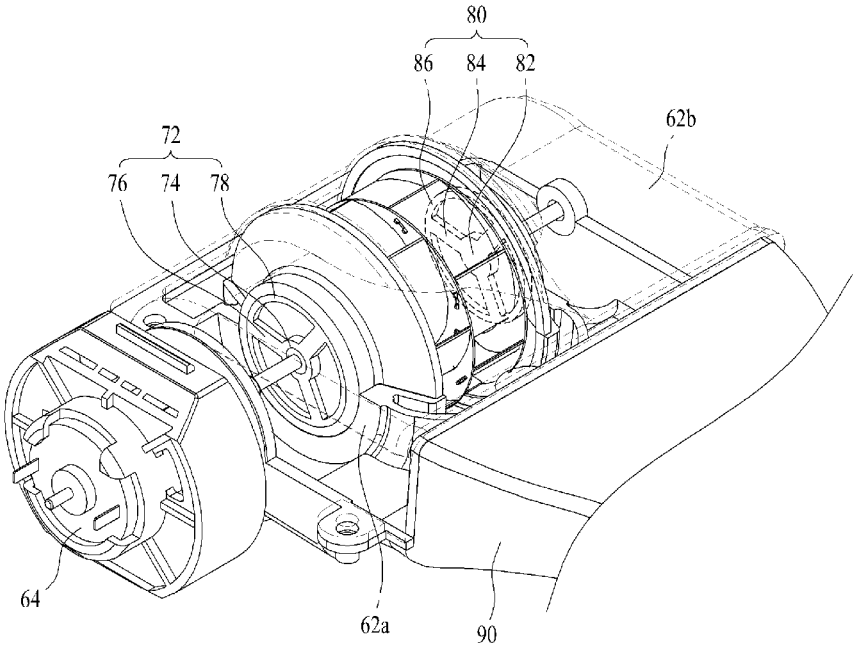
FIG. 10 is a view illustrating yet another modification of the suction unit of FIG. 7.

FIG. 10 is a view illustrating yet another modification of the suction unit of FIG. 7. Hereinafter, such a modification will be described with reference to FIG. 10.

The suction unit in accordance with the modification shown in FIG. 10 includes both the second bearing 72 and the third bearing 80 shown in FIGS. 8 and 9. Of course, the suction unit in accordance with the modification shown in FIG. 10 includes the first bearing 70 shown in FIG. 7.

For convenience, a description of the first bearing 70, the second bearing 72 and the third bearing 80 will be omitted.

Since the suction unit in accordance with the modification shown in FIG. 10 includes all of the first bearing 70, the second bearing 72 and the third bearing 80, the rotary shaft 66 is supported by the motor 64, the first bearing 80, the second bearing 72 and the third bearing 80, and thus noise and vibration generated from the rotary shaft 66 may be reduced.

As apparent from the above description, a robot cleaner in accordance with the present invention shortens a path along which sucked air moves to a suction unit, and may thus reduce loss of suction force.

Further, the robot cleaner in accordance with the present invention shortens a movement path of air, and thus, the inner space of the robot cleaner may be more effectively used.

Further, the robot cleaner in accordance with the present invention prevents sucked air from traversing a dust collector, and thus does not generate loss of suction force even if foreign substances are accumulated in the dust collector.

Further, the robot cleaner in accordance with the present invention may increase suction force of the suction unit, thus improving cleaning performance of the robot cleaner.

Moreover, the robot cleaner in accordance with the present invention may reduce noise generated due to rotation of fans.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A robot cleaner comprising:

a case forming the external appearance of the robot cleaner;

an agitator rotating and contacting a surface to be cleaned;

a dust collector in which foreign substances are collected; and a suction unit providing suction force to the dust collector, wherein the agitator is arranged between the dust collector and the suction unit, wherein the suction unit includes a guide duct unit guiding sucked air, wherein the guide duct unit has a first guide duct, a second guide duct arranged in parallel, a first air blower fan provided in the first guide duct, a second air blower fan provided in the second guide duct, and a motor provided at one side of the guide duct unit, so that the first guide duct and the second guide duct maintain separate airflow, wherein the width of an inlet of the guide duct is larger than the height of the inlet of the guide duct, wherein the air blower fans coaxially are connected to a rotary shaft of the motor and rotated, and wherein the rotary shaft is arranged to be parallel with the width of the inlet.

2. The robot cleaner according to claim 1, wherein an inlet through which foreign substances and air are sucked is provided at the dust collector and the inlet is inclined to the surface to be cleaned.

3. The robot cleaner according to claim 1, wherein an inlet through which foreign substances and air are sucked is provided at the dust collector and the inlet is formed at one side of the dust collector opposite the suction unit across the agitator.

4. The robot cleaner according to claim 1, wherein air is guided to the suction unit after passing through the dust collector.

5. The robot cleaner according to claim 1, wherein air flowing into the dust collector is guided so as to become distant from the suction unit.

6. The robot cleaner according to claim 1, wherein air discharged from the dust collector is guided so as to become close to the suction unit.

7. The robot cleaner according to claim 1, further comprising a communication pipe communicating the dust collector and the suction unit with each other.

8. The robot cleaner according to claim 7, wherein the communication pipe is provided above the agitator.

9. The robot cleaner according to claim 7, wherein:

an inlet through which foreign substances and air are sucked is provided at the dust collector; and an entrance of the communication pipe is formed above the inlet.

10. The robot cleaner according to claim 7, wherein a filter filtering out foreign substances is provided in the communication pipe.

11. The robot cleaner according to claim 1, wherein the dust collector includes a compression member compressing foreign substances.

12. The robot cleaner according to claim 11, wherein the compression member is reciprocally rotated about a vertical shaft to compress the foreign substances.

13. The robot cleaner according to claim 11, wherein the compression member is reciprocally rotated about a horizontal shaft to compress the foreign substances.

14. A robot cleaner comprising:

a case forming the external appearance of the robot cleaner;

an agitator rotating and contacting a surface to be cleaned;

a dust collector in which foreign substances are collected;

a suction unit providing suction force to the dust collector; and a communication pipe communicating the dust collector and the suction unit with each other, wherein the communication pipe is arranged above the agitator, wherein the suction unit includes a guide duct unit guiding sucked air through communication pipe, and wherein the guide duct unit has a first guide duct, a second guide duct arranged in parallel, a first air blower fan provided in the first guide duct, a second air blower fan provided in the second guide duct, and a motor provided at one side of the guide duct unit, so that the first guide duct and the second guide duct maintain separate airflow, wherein the width of an inlet of the guide duct is larger than the height of the inlet of the guide duct, wherein the air blower fans coaxially are connected to a rotary shaft of the motor and rotated, and wherein the rotary shaft is arranged to be parallel with the width of the inlet.

15. The robot cleaner according to claim 14, wherein air is sucked into the dust collector, and is guided to the suction unit via the communication pipe.

16. The robot cleaner according to claim 14, wherein air moving from the dust collector to the suction unit moves above the agitator.

17. A robot cleaner comprising:

a case forming the external appearance of the robot cleaner;

an agitator rotating and contacting a surface to be cleaned;

a dust collector in which foreign substances are collected; and a suction unit providing suction force to the dust collector, wherein air sucked into the dust collector moves so as to become distant from the suction unit, and air discharged from the dust collector moves so as to become close to the suction unit, wherein the suction unit includes a guide duct unit guiding sucked air, wherein the guide duct unit has a first guide duct, a second guide duct arranged in parallel, a first air blower fan provided in the first guide duct, a second air blower fan provided in the second guide duct, and a motor provided at one side of the guide duct unit, so that the first guide duct and the second guide duct maintain separate airflow, wherein the width of an inlet of the guide duct is larger than the height of the inlet of the guide duct, wherein the air blower fans coaxially are connected to a rotary shaft of the motor and rotated, and wherein the rotary shaft is arranged to be parallel with the width of the inlet.

18. The robot cleaner according to claim 17, wherein the dust collector includes a guide guiding the air, sucked into the dust collector, to the suction unit.

* * * * *